United States Patent [19]

De Vries

[11] Patent Number: 4,545,120

[45] Date of Patent: Oct. 8, 1985

[54] SHAVING APPARATUS

[75] Inventor: Jochem J. De Vries, Drachten, Netherlands

[73] Assignee: U.S. Philips Corporation, New York, N.Y.

[21] Appl. No.: 558,068

[22] Filed: Dec. 5, 1983

[30] Foreign Application Priority Data

Dec. 17, 1982 [NL] Netherlands ..... 8204879

[51] Int. Cl.[4] ..... B26B 19/42

[52] U.S. Cl. ..... 30/34.2

[58] Field of Search ..... 30/34.2

[56] References Cited

U.S. PATENT DOCUMENTS

| | | | |
|---|---|---|---|
| 4,258,470 | 3/1981 | Boiten | 30/34.2 |
| 4,275,497 | 6/1981 | Engelhardt | 30/34.2 |
| 4,329,781 | 5/1982 | Schemmann | 30/34.2 |

FOREIGN PATENT DOCUMENTS

| | | | |
|---|---|---|---|
| 7904042 | 11/1980 | Netherlands | 30/34.2 |

*Primary Examiner*—Jimmy C. Peters

*Attorney, Agent, or Firm*—Rolf E. Schneider

[57] ABSTRACT

A shaving apparatus has a circular shear plate provided with hair-entrance apertures and a cutting unit associated with and rotatable relative to the shear plate about an axis of rotation. The cutting unit comprises a cutting member having a circular central body, cutter arms extending from the periphery of the central body toward the shear plate, and a cutter formed at the end of each cutter arm, a part of each cutter arm extending in a substantially axial direction. A hair-pulling member has a circular central portion, hair-pulling-blade arms extending from the periphery of the central portion toward the shear plate, and a hair-pulling blade formed at the end of each hair-pulling-blade arm, each hair-pulling blade being associated with and movable relative to a cutter, a part of each hair-pulling-blade arm extending in a substantially axial direction. The axially directed part of each cutter arm and the axially directed part of its associated hair-pulling-blade arm are so positioned relative to each other that the axially directed part of the cutter arm is arranged radially opposite the axially directed part of the hair-pulling-blade arm and is situated at a greater radial distance from the axis of rotation than the axially directed part of the hair-pulling-blade arm.

4 Claims, 4 Drawing Figures

SHAVING APPARATUS

This invention relates to a shaving apparatus comprising a shear plate with hair-entry apertures and a cutting unit comprising a plurality of combinations each comprising a cutter and a hair-pulling blade, which unit is rotatable about an axis of rotation and comprises a cutting member which comprises a central body carrying cutter arms on its periphery, at least a part of each cutter arm extending in a substantially axial direction and carrying a cutter at the end of each cutter arm, each hair-pulling blade being arranged on the end of a hair-pulling-blade arm and at least a part of each hair-pulling-blade arm extending in a substantially axial direction.

Such a shaving apparatus is described in, for example, U.S. Pat. No. 3,962,784. When, during use of the apparatus, a hair-pulling blade comes into contact with a hair the hair-pulling blade moves away from the shear plate relative to the associated cutter. The hair-pulling-blade arm is thus subjected to elastic deformation. Therefore, the hair-pulling-blade arms are substantially less rigid and consequently weaker than the cutter arms. This means that the hair-pulling blade arms are more vulnerable to damage and deformation, in particular during assembly, disassembly or cleaning of the cutting units.

It is the object of the present to provide a less vulnerable construction and the invention is characterized in that the axially directed part of each cutter arm is arranged radially opposite the associated axially directed part of the hair-pulling-blade arm and is situated at a greater radial distance from the axis of rotation.

In this way the cutter arm protects the associated hair-pulling-blade arm against destructive external forces. Now it can also be achieved in a simple manner that the hair-pulling-blade arms as well as the hair-pulling blades do not project beyond the cutter arms and the cutters, respectively in the radial direction which reduces the likelihood of the hair-pulling blades and the hair-pulling blade arms coming into contact with the shear plate and producing an annoying noise during use of the apparatus.

The invention also relates to a cutting unit as described above.

The invention will now be described in more detail with reference to the accompanying drawings, in which.

Figure 1:
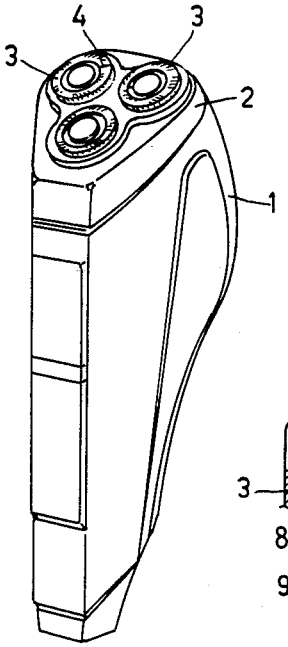
FIG. 1 is a perspective view of a shaving apparatus having three shear plates.

The shaving apparatus shown in FIG. 1 comprises a housing 1, of which a part 2 is formed as a shear-plate holder for three shear plates 3. The shear plates 3 are formed with hair-entrance apertures 4.

Figure 3:
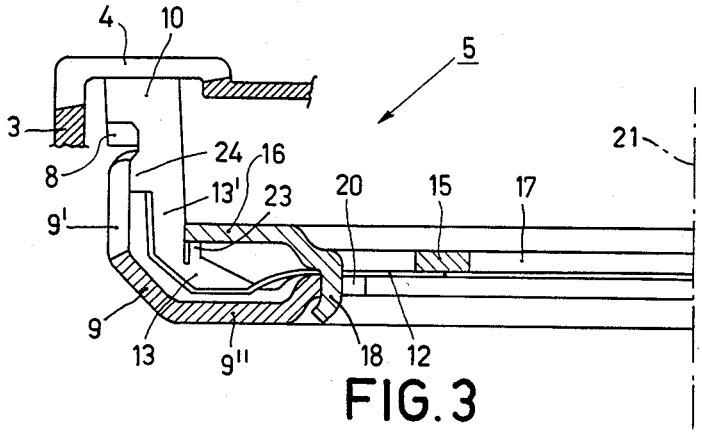
FIG. 3 is a sectional view on an enlarged scale of the cutting unit shown in FIG. 2 and a part of the shear plate.
Figure 4:
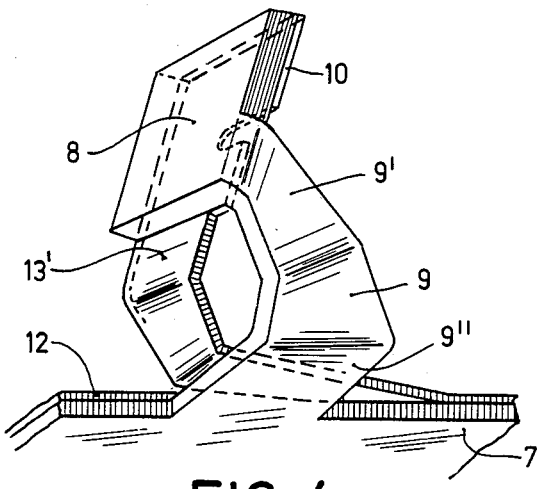
FIG. 4 shows on a further enlarged scale a part of the cutting unit shown in FIGS. 2 and 3.
Figure 2:
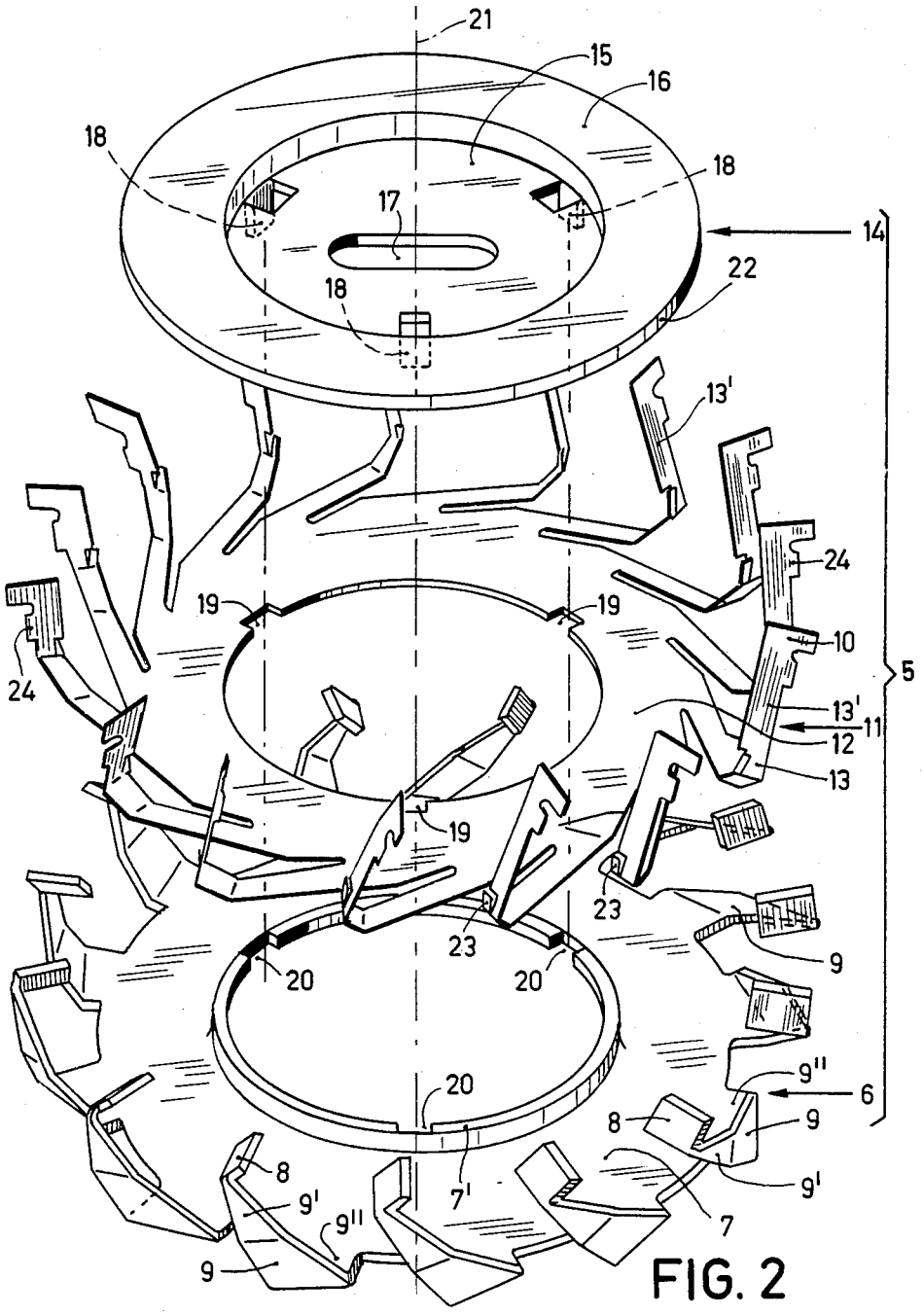
FIG. 2 is an exploded view of the cutting unit.

On the inner side of each shear plate is situated a cutting unit as shown in FIGS. 2 to 4 which unit can be rotated in a manner knwn per se.

The cutting unit 5 comprises a cutting member 6 which is generally manufactured integrally from a metal sheet and which substantially comprises an annular central body 7 provided with cutters 8 on its outer periphery, which cutters are respectively connected to the central body 7 by cutter arms 9. For each cutter 8 an associated hair-pulling blade 10 is provided. The hair-pulling blades 10 form part of a hair-pulling member 11 which is preferably also manufactured integrally from a thin elastic metal sheet. This hair-pulling member 11 comprises an annular central portion 12 to which the hair-pulling blades 10 are respectively connected by resilient hair-pulling-blade arms 13.

Owing to the resilience of the arms 13 the hair-pulling blades 10 can move away from the shear plate 3 relative to the cutters 8 to pull up the hairs slightly in known manner before the hairs are severed by the cutters. Such a combination comprising a cutter and a hair-pulling blade provides very good shaving results.

The cutting unit 5 also comprises a clamping member 14 which comprises a central disc 15 and an annular flanged rim 16 which is offset relative to the plane of said central disc. The central disc 15 is formed with a coupling aperture 17.

In the assembled condition of the cutting unit the three parts are fitted onto each other in the sequence indicated in FIG. 2 and as shown in the sectional view of FIG. 3. The central portion 12 of the hair-pulling member 11 is then clamped between the central disc 15 of the clamping member 14 and a raised rim 7' at the inner periphery of the central body 7 of the cutting member. The clamping member 14 is formed with lugs 18 which engage in recesses 19 and 20 in the central portion 12 and the central body 7, respectively, and which are bent over slightly at their ends, so that the cutting member, the hair-pulling member and the clamping member 4 are centered relative to each other and secured to each other.

In this assembled condition of the cutting unit 5 the cutter arm 9 is bent outwardly over the associated hair-pulling-blade arm 13 (see also FIG. 4). The part 9' of each cutter arm 9, which part extends substantially in the axial direction, is then situated opposite the part 13' of the associated hair-pulling-blade arm 13, which part extends substantially in the axial direction, said part 9' being situated at a greater radial distance from the axis of rotation 21 than the part 13'. In this way the cutter-arm part 9' protects the part 13' of the hair-pulling-blade arm against undesired external influences. In particular, when the cutting unit is removed from the apparatus, for example for cleaning purposes, the likelihood of damage to the vulnerable hair-pulling blades and hair-pulling-blade arms is reduced substantially. Also, the cutting unit may be held by the ring of cutters without the hair-pulling blades being touched.

In the present embodiment the hair-pulling member 11 is situated within the cutting member, i.e. the central portion 12 of the hair-pulling member is situated at that side of the central body 7 of the cutting member 6 which faces the shear plate 3, so that the hair-pulling-blade arms 13 are situated almost completely within the cutter arms 9 and are shielded by these arms. The radial part 9'' of a cutter arm 9 of the central body 7 can simply constitute a stop which limits the deflection of the associated hair-pulling-blade arm and, consequently, of the hair-pulling blade in an axial direction away from the shear plate. The outer edge 22 of the flanged rim 16 of the clamping member 14 forms a stop which thus limits the deflection of the hair-pulling blades in a radially inward direction.

The hair-pulling-blade arms 13 are provided with projections 23 and 24 which respectively lie against the flanged rim 16 and against the inner sides of the parts 9' of the cutter arms 9, so that axial deflection of the hair-pulling blades towards the shear plate 3 and deflection of such a radially outward direction blades are limited.

Alternatively, the cutting unit may be equipped with hair-pulling blades and hair-pulling-blade arms which are not combined on a hair-pulling member. The ends of the hair-pulling-blade arms may then, for example, be clamped between the central disk 15 and the raised rim 7' on the central body 7.

Alternatively, the clamping member 14 may be provided with spokes, the ends of the hair-pulling-blade arms being clamped between the spokes and the cutting member and the ends of the spokes constituting stops for the parts of the hair-pulling-blade arms which adjoin the hair-pulling blades.

What is claimed is:

1. A shaving apparatus having a circular shear plate provided with hair-entrance apertures and a cutting unit associated with and rotatable relative to the shear plate about an axis of rotation; said cutting unit comprising a cutting member having a circular central body, cutter arms extending from the periphery of said central body toward the shear plate, a cutter formed at the end of each cutter arm, a part of each cutter arm extending in a substantially axial direction, a hair-pulling member having a circular central portion, hair-pulling-blade arms extending from the periphery of said central portion toward the shear plate, a hair-pulling blade formed at the end of each hair-pulling-blade arm, each hair-pulling blade being associated with and movable relative to a cutter, and a part of each hair-pulling-blade arm extending in a substantially axial direction; the axially directed part of each cutter arm and the axially directed part of its associated hair-pulling-blade arm being so positioned relative to each other that the axially directed part of the cutter arm is arranged radially opposite the axially directed part of the hair-pulling-blade arm and is situated at a greater radial distance from the axis of rotation than the axially directed part for the hair-pulling-blade arm.

2. A shaving apparatus according to claim 1, in which a radially directed part of each cutter arm constitutes a stop limiting the axial deflection of its associated hair-pulling-blade arm.

3. A shaving apparatus according to claim 1, in which the cutting unit includes a separate member having an annular rim situated adjacent the hair-pulling-blade arms and constituting a stop limiting the radial deflection of said arms.

4. A shaving apparatus according to claim 3, in which the annular rim constitutes a stop also limiting the axial deflection of the hair-pulling-blade arms.

* * * * *